United States Patent [19]

Hasegawa

[11] 4,318,474

[45] Mar. 9, 1982

[54] 12-PACK CARRY BACK CARTON

[75] Inventor: Gary K. Hasegawa, Chicago, Ill.

[73] Assignee: The Continental Group, Inc., Stamford, Conn.

[21] Appl. No.: 95,919

[22] Filed: Nov. 19, 1979

[51] Int. Cl.[3] ..... B65D 5/46; B65D 5/54

[52] U.S. Cl. ..... 206/428; 206/199; 206/620; 229/52 B

[58] Field of Search ..... 229/52 B; 206/620, 162, 206/199, 427, 428; 229/52 BC

[56] References Cited

U.S. PATENT DOCUMENTS

| | | | |
|---|---|---|---|
| 2,785,847 | 3/1957 | Forrer | 229/52 B |
| 2,802,615 | 8/1957 | Radke | 229/52 B |
| 3,094,268 | 6/1963 | Swanson et al. | 229/52 B |
| 3,540,581 | 11/1970 | Koolnis | 229/52 B X |
| 3,696,990 | 10/1972 | Dewhurst | 229/52 B X |
| 3,904,036 | 9/1975 | Forrer | 206/427 |
| 3,933,303 | 1/1976 | Kirby, Jr. | 229/52 B |
| 3,974,911 | 8/1976 | Graser | 229/52 B X |
| 3,994,432 | 11/1976 | Kirby, Jr. | 206/427 X |
| 4,121,757 | 10/1978 | Hamlin | 229/52 B |
| 4,222,485 | 9/1980 | Focke | 229/52 B |

*Primary Examiner*—Stephen P. Garbe

*Attorney, Agent, or Firm*—John J. Kowalik

[57] ABSTRACT

A multi-pack can carrying carton in which the side and top walls are perforated to provide removable panels which upon removal leave portions of the carton as a handle for the carton to carry returnable empty cans and to provide access openings into the carton, the access openings being shaped and strategetically located to improve visibility and accessibility.

8 Claims, 9 Drawing Figures

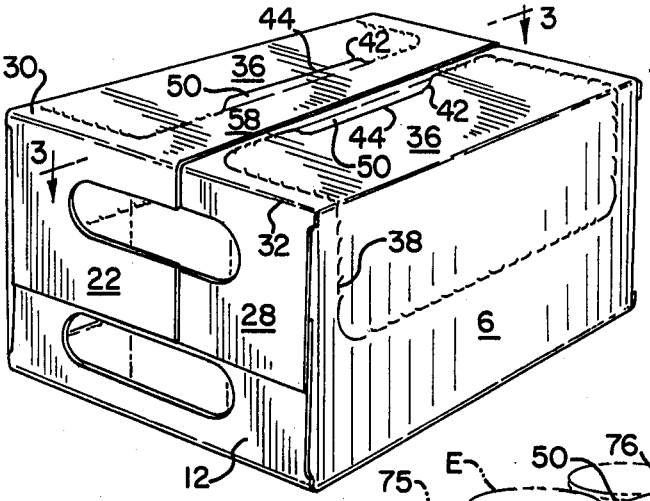
FIG. 1
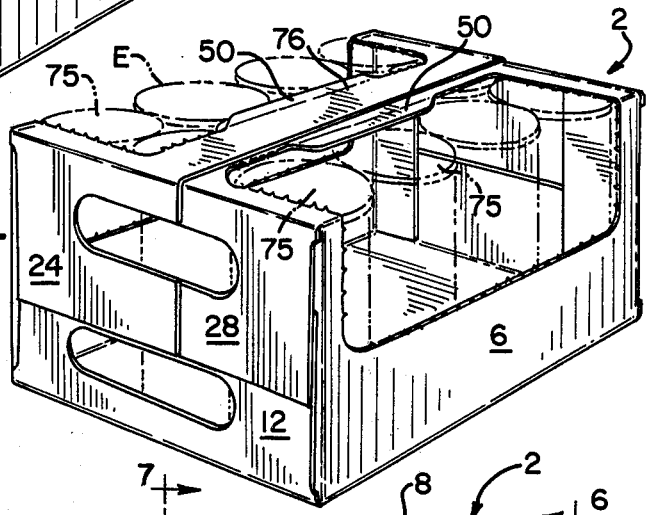
FIG. 2
FIG. 3
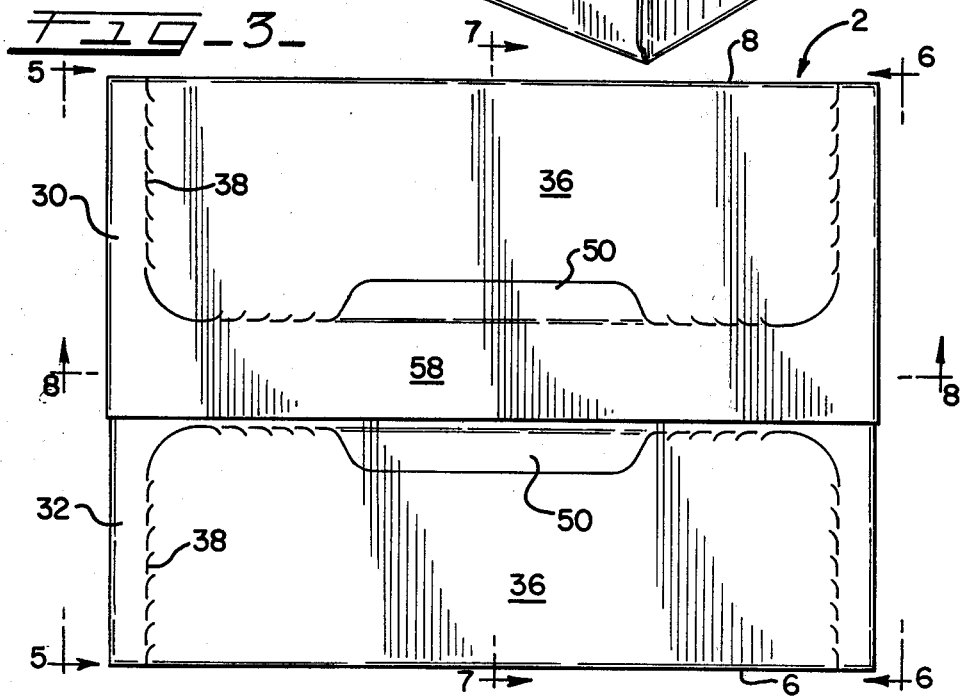

12-PACK CARRY BACK CARTON

BACKGROUND OF THE INVENTION

Various States presently have anti-littering legislation which requires the return of empty beverage cans and bottles. A high deposit is mandated to encourage collection and return of the empties.

In analyzing the market for can containers for beverages, it was apparent that heretofore, although cartons were used in the scale of canned beer and soft drinks, such cartons were primarily made so that they were not entirely useful as a return package. Such prior cartons would ordinarily be broken apart and discarded by the user as the product was being consumed.

SUMMARY OF THE INVENTION

The primary object of the invention is to provide a practical, easily produceable carton for packaging canned beverages and which also serves, after parts are removed from the original carton, as a handy carrying basket for empty cans.

The invention comprehends providing a carton wherein the end and top walls terminate and have together overlapped connected portions at the center of the top of the carton which form a carrying handle for the carton, the handle being reinforced by side flaps which are the remains of the portions of the top walls after the perforated portions are removed. The flaps in being tucked under the handle tend to spring back and wedge between the handle and the empty cans which are positioned thereunder to hold them in place and keep them from falling out, particularly when they are being tilted during stacking at a high level where there is a tendency for the stacker to tilt the case.

A further object is to provide in the end panels which also have overlapped glued together portions in which are provided a pair of parallel, elongated, hand-admitting slots for carrying a full pack, the end walls having portions overlapped vertically as well as horizontally, thus providing a strong three-ply laminate at the handhold between the slots.

These and other objects and advantages inherent in and encompassed by the invention will become more apparent from the specification and the drawings wherein FIG. 1 is a perspective view of the novel carton;

FIG. 2 is a further perspective view of the carton showing the perforated portions removed;

FIG. 3 is a top plan view on an elongated scale of the carton shown in FIG. 1;

DESCRIPTION OF THE INVENTION

Figure 5:
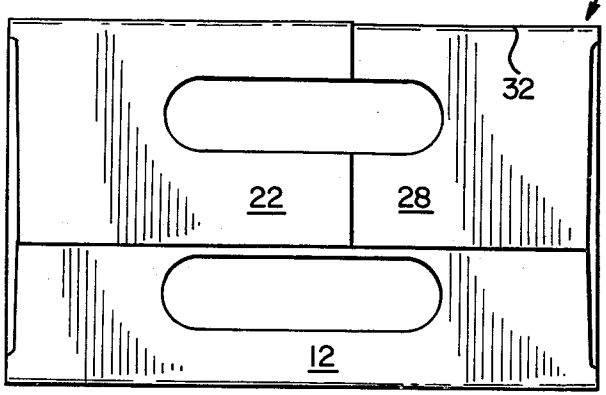
FIG. 5 is one end view thereof.
Figure 7:
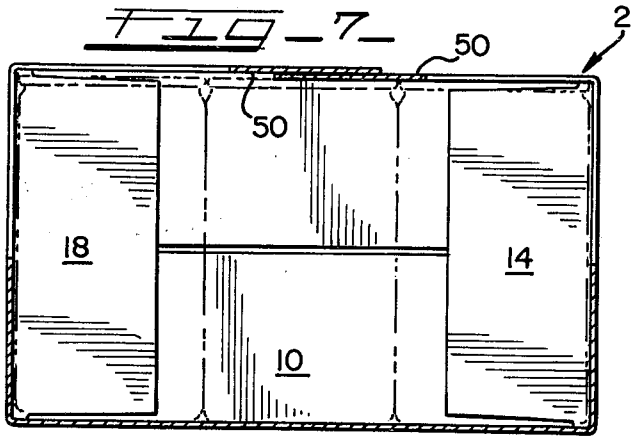
FIG. 7 is a cross-sectional view taken substantially on line 7—7 of FIG. 3.
Figure 4:
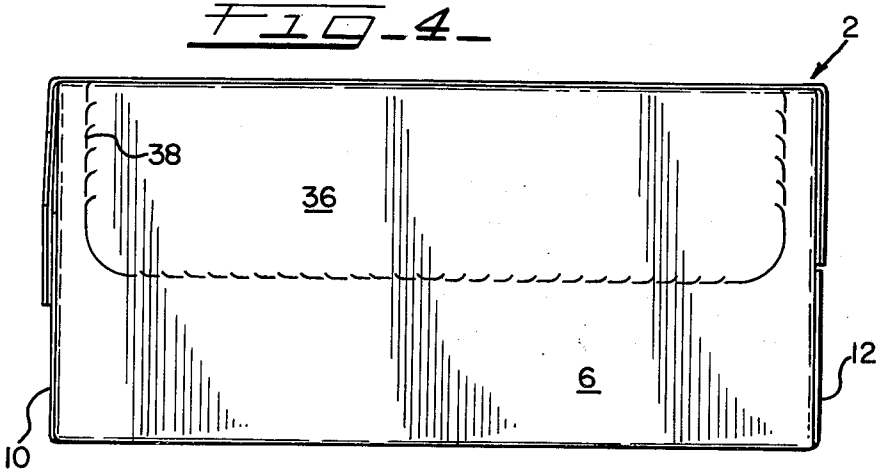
FIG. 4 is a side elevational view thereof.
Figure 6:
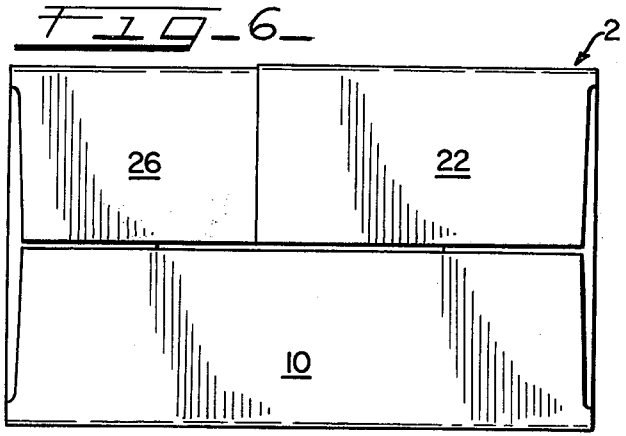
FIG. 6 is an opposite end view thereof.
Figure 8:
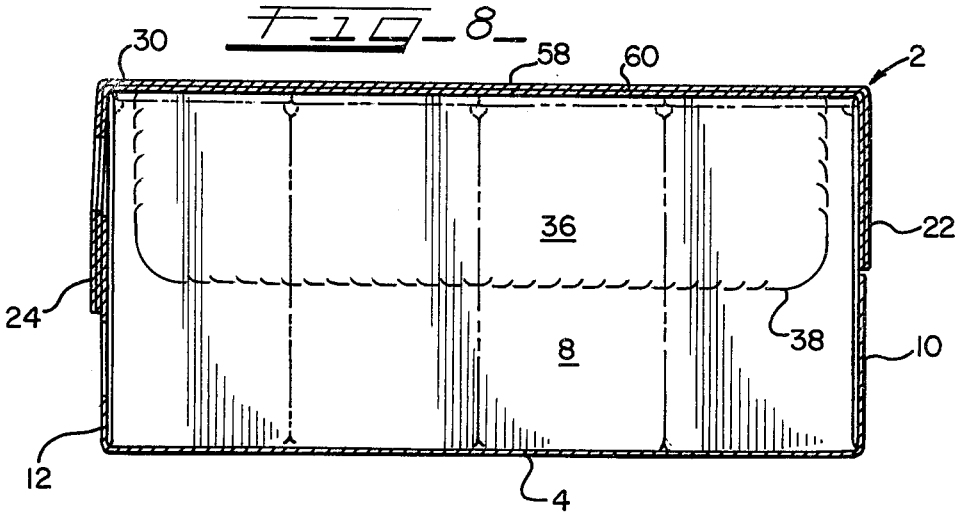
FIG. 8 is a longitudinal sectional view taken substantially on line 8—8 of FIG. 3.
Figure 9:
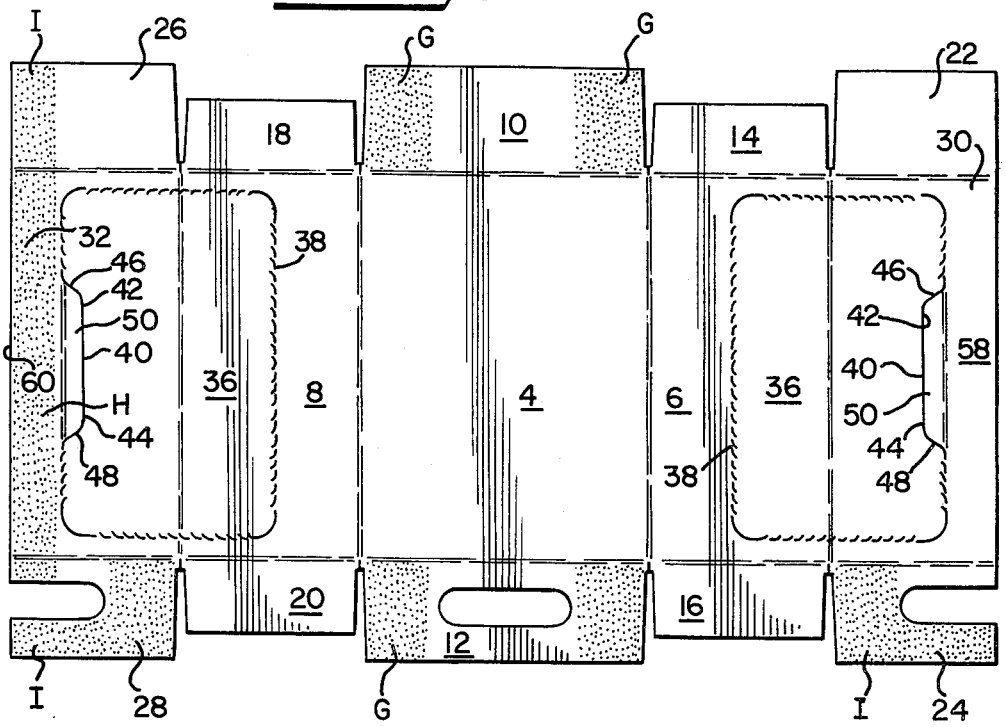
FIG. 9 is a plan view of the blank from which the carton is made.

The carton 2 is made from the blank shown in FIG. 9 which comprises a bottom wall 4, side walls 6,8, lower end wall sections 10,12 at opposite ends of the bottom wall and end wall tabs 14,16 and 18,20 at opposite ends of the side walls 6,8 and end wall tabs 22,24 and 26,28 at opposite ends of the top wall portions 32,32.

Approximatey centrally thereof there is provided in each side wall and its contiguous top wall section a removable panel 36 which is generally centered on the respective side wall and top wall section and is outlined by perforations 38.

A portion of the outline at the free edge 40 of the respective top wall section is cut through at 42 as a continuation of the perforation. This cutout is elongated longitudinally of the container and is somewhat U-shaped with a long cut 44 at its base and short diverging leg portions 46,48 at opposite ends of the cut 44 and thus forming a tab 50. The paper cardboard-like material where the tab adjoins the top wall portion outwardly of the removable panel is flexible.

In assembling and forming the carton, the side walls 6 and 8 thereof are folded upright along the scores 54,56. Then the end wall tabs 14–20 are also folded upright. Then the lower end wall sections 10 and 12 are positioned upright and overlapped behind the sections 14,18 and 16,20 respectively and glued thereto with the adhesive identified at G. Then the top wall sections 30,32 are positioned horizontally and their free edge portions 58,60 are overlapped and adhered to one another by the adhesive H on portion 60 while the top wall sections 30,32 are being folded. The end wall tabs 22, 26 and 64,65 are also folded downwardly over the respective tabs 14,20.

It will be seen that the tabs 22,26 extend to the adjacent edges of the lower end wall section 10 and that tabs 24,28 are coated with an adhesive I which is adhered to tabs 18 and 14, thus forming one composite end wall of the container.

The other end wall of the container is formed by the wall section 12 overlapping tabs 18,14 and glued thereto by adhesive G and tabs 22,26 overlap tabs 14,18 and 10 and are adhered to wall section 10 by adhesive I.

It will be noted that tabs 24,28 are also overlapped and with the wall section 12 form a three-layer ply between the elongated hand accommodating holes 70,72 and the portion 73 between the holes forms a carrying handle for the case when the carton has filled cans which are relatively heavy.

To give access into the carton, the panels 36,36 are torn away by the person inserting a hand into the apertures formed in the top of the carton when the tabs 50,50 are depressed. As the produce is consumed, the empty cans 75 are returned to the carton in three rows of four comprising a center row C and end rows E,E.

The tabs 50,50 are folded under the two-ply handle 76 formed by the portion 58,60 which are glued to each other by the glue at H. These tabs after being foled under the handle are biased downwardy due to the spring back of the thick paper cardboard material along the hinge where the tabs are bent, and bear against the cans in the center row. This controls the shifting of the cans and aids in retaining them in the carton, particularly when the carton is tipped so that the empty cans connot readily fall out.

What is claimed is:

1. A carton for initially carrying filled cans and then empty cans comprising a top, a bottom, two sides and two ends wherein one of the ends is comprised of a three-ply laminated hand hold portion said hand hold being flanked by a pair of hand holes in said end wall, and said carton top having a pair of top wall portions overlapped adjacent to the center of the carton and forming a two-ply handle for carrying a carton filled with empty cans, said handle having a pair of tabs one at each side of the handle foldable thereunder under stress over a row of cans disposed thereunder for holding the cans against lateral displacement.

2. The invention according to claim 1 and said two sides and said top having removable panel portions forming said carton into a basket-like structure with access openings into the container and the panel portions terminating in laterally spaced relation to each other at said top at opposite sides of the longitudinal center line of the carton and defining the lateral edges of a carrying handle for the basket-like structure upon removal of said panel portions.

3. The invention according to claim 1 and each said top wall portion and adjacent side having a perforation therein outlining a panel and terminating at the respective tab, each panel being removable to provide access into said carton.

4. A can packaging carton for initially carring three side by side upright rows of product filled cans and then as a carton for returning empty cans, each can having upper and lower ends, said carton comprising top, bottom, end and side walls, means including a strong multiply portion formed from one of said end walls providing a first carrying handle for the carton for sustaining the load of filled cans, means for providing an access opening into the carton from a side and top thereof, and a second carrying handle extending between said end walls for carrying a carton filled with empty cans and having at least one tab projecting laterally outwardly from one side of the second handle, said tab being foldable to a position between the second handle and one of the ends of certain cans within the carton for biasing the second handle upwardly and the cans therebeneath downwardly and thereby holding said cans against shifting within the carton.

5. The invention according to claim 4 and said carton being made of thick paper.

6. The invention according to claim 5 and said top and side wall having means providing an access opening at the opposite side of said second handle and a second tab on the second handle biased between said second handle and certain of said cans in the container for holding the same against shifting.

7. The invention according to claim 6 and said handle being formed from portions of said top wall as a laminate having at least two plies.

8. The invention according to claim 7 and at least one end wall being in part a three-ply laminate including overlapped portions extending from the side, top and bottom walls and comprising means formed to provide a hand hold for said carton.

* * * * *